US010784045B2

(12) United States Patent
Deligianni et al.

(10) Patent No.: US 10,784,045 B2
(45) Date of Patent: Sep. 22, 2020

(54) LAMINATED MAGNETIC MATERIALS FOR ON-CHIP MAGNETIC INDUCTORS/TRANSFORMERS

(71) Applicant: International Business Machines Corporation, Armonk, NY (US)

(72) Inventors: Hariklia Deligianni, Alpine, NJ (US); William J. Gallagher, Ardsley, NY (US); Sathana Kitayaporn, Portland, OR (US); Eugene J. O'Sullivan, Nyack, NY (US); Lubomyr T. Romankiw, Briancliff Manor, NY (US); Naigang Wang, Ossining, NY (US); Joonah Yoon, Fishkill, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 14/854,523

(22) Filed: Sep. 15, 2015

(65) Prior Publication Data

US 2017/0076852 A1 Mar. 16, 2017

(51) Int. Cl.
*H01F 41/04* (2006.01)
*H01F 10/32* (2006.01)
*H01F 5/00* (2006.01)

(52) U.S. Cl.
CPC ..... *H01F 41/043* (2013.01); *H01F 5/003* (2013.01); *H01F 10/3204* (2013.01)

(58) Field of Classification Search
CPC . H01L 27/22; H01L 25/167; H01L 21/02543; H01L 27/00; H01F 7/021;
(Continued)

(56) References Cited

U.S. PATENT DOCUMENTS 4,587,178 A 5/1986 Shimizu et al.
5,032,945 A * 7/1991 Argyle ..... B82Y 25/00 360/125.39

(Continued)

FOREIGN PATENT DOCUMENTS

JP 60149785 A 8/1985

OTHER PUBLICATIONS

Hariklia Deligianni, "Laminated Magnetic Materials for On-Chip Magnetic Inductors/Transformers" U.S. Appl. No. 14/950,364, filed Nov. 24, 2015.

(Continued)

*Primary Examiner* — Tabassom Tadayyon Eslami
(74) *Attorney, Agent, or Firm* — Cantor Colburn LLP; Vazken Alexanian

(57) ABSTRACT

A technique relates to a method of forming a laminated multilayer magnetic structure. An adhesion layer is deposited on a substrate. A magnetic seed layer is deposited on top of the adhesion layer. Magnetic layers and non-magnetic spacer layers are alternatingly deposited such that an even number of the magnetic layers is deposited while an odd number of the non-magnetic spacer layers is deposited. The odd number is one less than the even number. Every two of the magnetic layers is separated by one of the non-magnetic spacer layers. The first of the magnetic layers is deposited on the magnetic seed layer, and the magnetic layers each have a thickness less than 500 nanometers.

3 Claims, 17 Drawing Sheets

(58) Field of Classification Search
CPC ..... H01F 27/00; H01F 41/043; H01F 41/305; H01F 41/306; H01F 41/307; H01F 10/3204
USPC ..... 427/127, 128, 129, 130, 131, 132; 428/694, 694 E, 811.3; 336/234
See application file for complete search history.

(56) References Cited

U.S. PATENT DOCUMENTS 5,576,099 A 11/1996 Canaperi et al.
5,846,648 A 12/1998 Chen et al.
5,901,432 A * 5/1999 Armstrong ..... G11B 5/3116 205/122
6,226,159 B1 * 5/2001 Pinarbasi ..... B82Y 10/00 360/324.11
6,542,340 B1 4/2003 Hayashi
6,743,503 B1 * 6/2004 Chen ..... C23C 14/165 204/192.1
7,719,084 B2 5/2010 Gardner et al.
7,738,220 B1 * 6/2010 Fukuzawa ..... B82Y 10/00 360/324.12
7,755,124 B2 7/2010 Fajardo et al.
9,166,143 B1 * 10/2015 Gan ..... H01L 43/08
2002/0044379 A1 4/2002 Kobayashi et al.
2003/0179601 A1 * 9/2003 Seyyedy ..... G11C 11/15 365/158
2004/0029296 A1 * 2/2004 Tuttle ..... H01L 27/222 438/3
2005/0153481 A1 * 7/2005 Tei ..... C23C 18/1692 438/123
2005/0245080 A1 * 11/2005 Wang ..... H01L 21/02074 438/678
2006/0256484 A1 * 11/2006 Sato ..... B82Y 10/00 360/324.2
2007/0285835 A1 12/2007 Sun et al.
2008/0003760 A1 * 1/2008 Gardner ..... H01F 10/16 438/381
2008/0157911 A1 7/2008 Fajardo et al.
2009/0021863 A1 1/2009 Zheng
2013/0032911 A1 * 2/2013 Jung ..... H01L 43/08 257/421
2013/0042081 A1 * 2/2013 Park ..... H01L 43/08 711/154
2013/0059168 A1 * 3/2013 Tahmasebi ..... H01L 43/08 428/811.2
2013/0285257 A1 10/2013 Lee et al.
2014/0021426 A1 * 1/2014 Lee ..... H01L 43/02 257/1
2014/0191362 A1 * 7/2014 Gallagher ..... H01L 28/10 257/531
2014/0216939 A1 * 8/2014 Fontana, Jr. ..... C25D 7/123 205/50
2015/0061050 A1 * 3/2015 Zhou ..... G11C 11/161 257/421
2015/0200231 A1 * 7/2015 Herget ..... H01F 7/021 257/421
2016/0099407 A1 * 4/2016 Lim ..... H01L 43/08 257/425

OTHER PUBLICATIONS

List of IBM Patent Applications Treated as Related; Date Filed: Sep. 15, 2015, p. 1-2.
J.C. Slonczewski et al., "Micromagnetics of laminated Permalloy films," IEEE Transactions on Magnetics, vol. 24, No. 3, May 1988, pp. 2045-2054.
M. Sun et al., "Electrodeposition of NiP Film used as a Nonmagnetic Spacer in Laminated (CoFe/NiP)n. Writer Pole," ECS Trans., vol. 16, Issue 45, 2009, pp. 177-186.
S. Bae et al., "High Q Ni—Zn—Cu Ferrite Inductor for On-Chip Power Module," IEEE Transactions on Magnetics, vol. 45, No. 10, Oct. 2009, pp. 4773-4776.
X. Xing et al., "RF Magnetic Properties of FeCoB/Al2O3/FeCoB Structure With Varied Al2O3 Thickness," IEEE Transactions on Magnetics, vol. 47, No. 10, Oct. 2011, pp. 3104-3107.
Kuo et al., "The activation effect of Pd nanoparticles on electroless nickel-phosphorous deposition", Electrochimica Acta, 2006, vol. 52, pp. 353-360.

* cited by examiner

| | | |
|---|---|---|
| BORIC ACID | | 0.50M |
| SODIUM CITRATE DIHYDRATE | | 0.50M |
| COBALT SULFATE HEPTAHYDRATE | | 0.07M |
| SODIUM TUNGSTATE DIHYDRATE | | 0.40M |
| LEAD ACETATE | | 0.10ppm |
| POLYETHYLENE GLYCOL (PEG) | | 5.00ppm |
| SODIUM HYPOPHOSPHITE MONOHYDRATE | | 0.34M |
| | pH | 9.00 |
| | TEMPERATURE | 90 C |

TABLE 1: BATH COMPOSITION AND OPERATING CONDITIONS OF ELECTROLESS CoWP

FIG. 3

| | | |
|---|---|---|
| NICKEL SULAFTE HEXAHYDRATE | | 25 g/L |
| SODIUM ACETATE | | 10 g/l |
| SODIUM HYPOPHOSPHITE MONIHYDRATE | | 30 g/l |
| | | |
| | pH | 4 |
| | TEMPERATURE | 50 C |

TABLE 2: BATH COMPOSITION AND OPERATING CONDITIONS OF NiP

FIG. 5

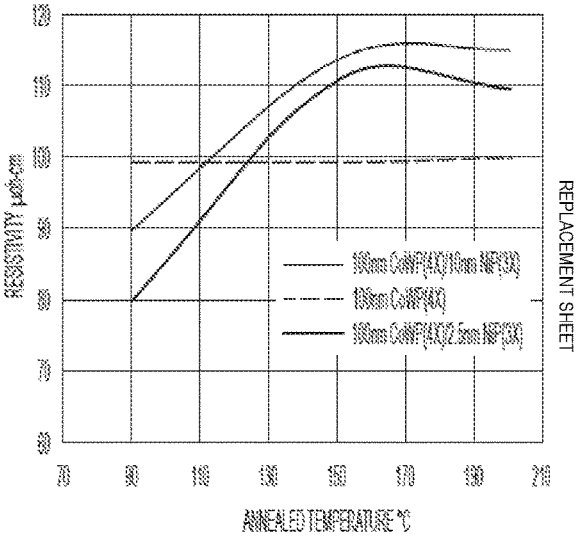
FIG. 13B
REPLACEMENT SHEET

LAMINATED MAGNETIC MATERIALS FOR ON-CHIP MAGNETIC INDUCTORS/TRANSFORMERS

STATEMENT REGARDING FEDERALLY SPONSORED RESEARCH OR DEVELOPMENT

This invention was made with Government support under University of California Subcontract B601996 awarded by the Department of Energy. The Government has certain rights to this invention.

BACKGROUND

The present invention relates to a magnetic structure, and more specifically, to laminated magnetic material for on-chip magnetic inductors/transformers.

Electroless plating is a technique of plating metal by chemical rather than electrical means, in which the piece to be plated is immersed in a reducing agent that, when catalyzed by certain materials, changes metal ions to metal that forms a deposit on the piece.

Further, electroless plating, also known as chemical or auto-catalytic plating, is a non-galvanic plating method that involves several simultaneous reactions in an aqueous solution, which occur without the use of external electrical power. It is mainly different from electroplating by not using external electrical power. On the other hand, electroplating is a process that uses electric current to reduce dissolved metal cations so that they form a coherent metal coating on, e.g., an electrode.

SUMMARY

According to one embodiment, a method of forming a laminated multilayer magnetic structure is provided. The method includes depositing an adhesion layer on a substrate, depositing a magnetic seed layer on top of the adhesion layer, and alternatingly depositing magnetic layers and non-magnetic spacer layers such that an even number of the magnetic layers is deposited while an odd number of the non-magnetic spacer layers is deposited. The odd number being one less than the even number. Every two of the magnetic layers is separated by one of the non-magnetic spacer layers, and the first of the magnetic layers is deposited on the magnetic seed layer. The magnetic layers each have a thickness less than 500 nanometers.

According to one embodiment, a laminated multilayer magnetic structure is provided. The structure includes an adhesion layer deposited on a substrate, a magnetic seed layer deposited on top of the adhesion layer, and magnetic layers and non-magnetic spacer layers alternatingly deposited such that an even number of the magnetic layers is deposited while an odd number of the non-magnetic spacer layers is deposited. The odd number is one less than the even number. Every two of the magnetic layers is separated by one of the non-magnetic spacer layers. The first of the magnetic layers is deposited on the magnetic seed layer, and the magnetic layers each have a thickness less than 500 nanometers.

BRIEF DESCRIPTION OF THE DRAWINGS

FIG. 3 is a table of parameters for bath composition and operating conditions of electroless plating for CoWP according to an embodiment;

FIG. 5 is a table of parameters for bath composition and operating conditions of electroless plating for NiP according to an embodiment;

FIG. 13B is a graph of resistivity as a function of annealing temperature for laminated CoWP and NiP structures according to an embodiment;

DETAILED DESCRIPTION

One or more embodiments describe plated magnetic film materials required for 90% efficient monolithically integrated microbuck converters. According to one or more embodiments, the technique for the microbuck converters scale up CoWP electroless deposition chemistry for 200 millimeter (mm) wafers and uses NiP lamination layers.

Miniaturization of magnetic inductors and integration on semiconductor chips requires the use of high performance magnetic materials. In one or more embodiments, the requirements met include soft magnetic properties with low coercive force ($Hc<1.0$ oersted (Oe)) and high saturation magnetization, high resistivity ($\rho>=110$ microohm centimeter ($\mu\Omega\cdot cm$)) to reduce inductor losses at high frequencies from eddy currents, and excellent thermal stability to a processing temperature that is dictated by the integration process on-chip (≥200-250° Celsius (C.)).

One or more embodiments demonstrate that a $Co_{85}W_5P_{10}$ thin film deposited using an electroless chemistry on a Pd activated crystalline $Ni_{80}Fe_{20}$ or on amorphous CoFeB seed layer meets all the material requirements for a low process temperature integrated inductor. The electroless process was scaled up to 200 millimeter (mm) wafer size using a large magnet capable of applying 0.15 Telsa (T) at the wafer center. Typically, single thin magnetic films can have a complicated magnetic domain structure. Since most of the on-chip devices are operated at high frequencies (>100 megahertz (MHz)), a large eddy current could be induced within magnetic core which results in high alternating current (AC) losses at high frequency. One way to reduce eddy currents is to laminate the magnetic core/yoke with insulator spacers so that the eddy currents are confined within each magnetic layer. As the thickness of each magnetic layer gets thinner, the effective resistance of each magnetic layer gets larger, and hence the eddy currents are smaller.

Figure 1:
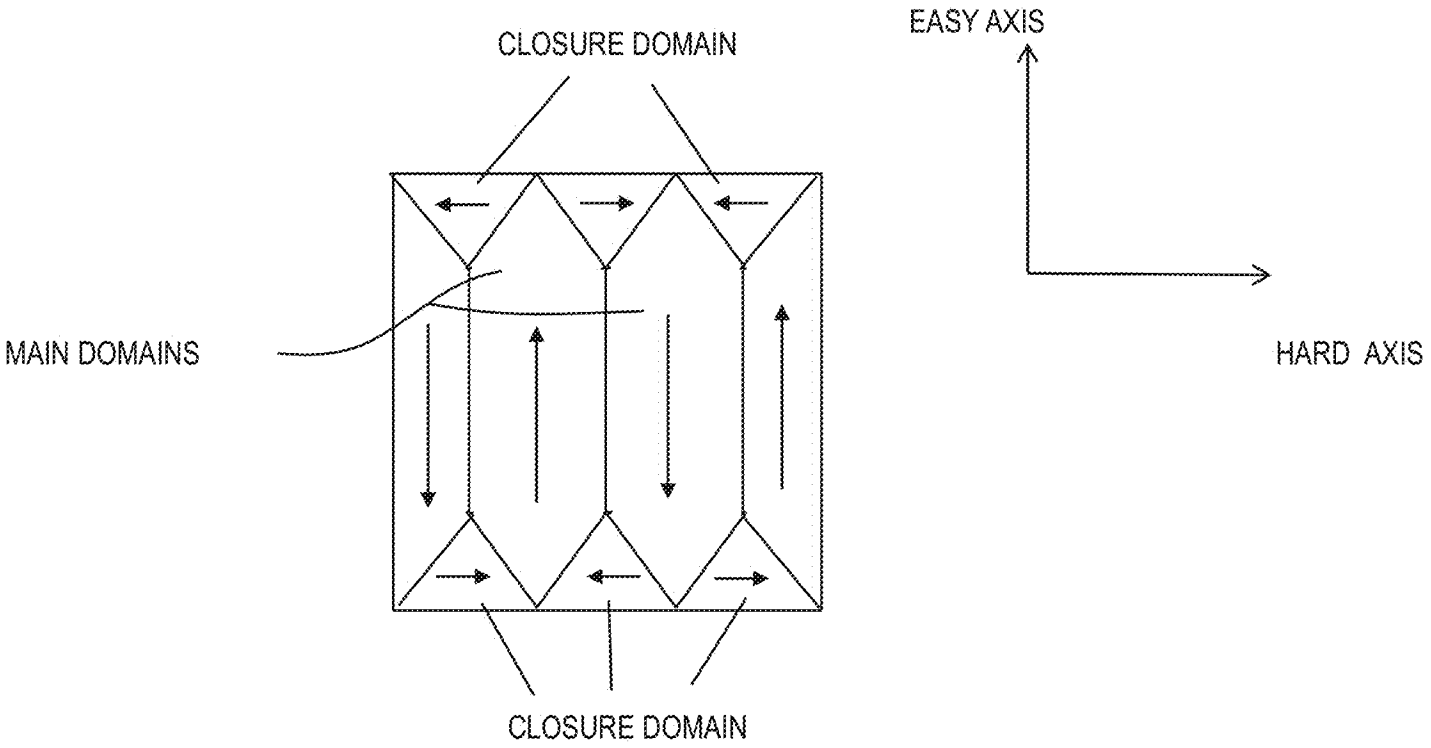
FIG. 1 is a schematic diagram illustrating magnetic domains in magnetic material layer.

Another function of the magnetic lamination is to control the magnetic domains. For on-chip planar inductors, magnetic anisotropy (i.e., easy and hard axis) has to be well defined. In the demagnetized state, the magnetic domain forms a flux-closed configuration at the edges of the pattern as shown in FIG. 1. FIG. 1 illustrates the magnetic domains for the closure domains and the main domains. They represent the magnetic anisotropy in the easy and hard axes. At a relatively low frequency of applied signal to the inductor, the flux propagation (along the hard axis) is governed by both the magnetization rotation and domain wall movement. In addition to the hysteresis loss, the domain wall movements can also induce local eddy currents which will add to the total loss. At a very high frequency (>100 MHz) of the signal applied to the inductor, only the magnetization rotation contributes to the permeability since domain wall movement is too slow to move. The inactive fraction parallel to the hard axis within the closure domains does not respond to the fast magnetic field changes, and hence the high frequency permeability is reduced. Therefore, elimination of the closure domains has the potential to reduce the loss and increase high frequency permeability, which is particularly desired for on-chip inductors. Closure domains can be eliminated by laminating the magnetic materials with a non-magnetic spacer. The magneto-static coupling between two adjacent magnetic layers through the non-magnetic spacer layers removes the closure domains.

According to embodiments, laminated multilayer structures were fabricated using thin nonmagnetic insulating films of NiP ($Ni_3P$). The NiP films were also deposited by electroless deposition and are non-magnetic. According to one embodiment, there are two particular requirements for the NiP lamination layer: 1) to be pinhole free, and 2) to allow interlayer magneto static coupling between the magnetic thin films.

In materials that exhibit antiferromagnetism, the magnetic moments of atoms or molecules, usually related to the spins of electrons, align in a regular pattern with neighboring spins (on different sublattices) pointing in opposite directions. Antiferromagnets can couple to ferromagnets, for instance, through a mechanism known as exchange bias, in which the ferromagnetic film is either grown upon the antiferromagnet or annealed in an aligning magnetic field, causing the surface atoms of the ferromagnet to align with the surface atoms of the antiferromagnet. This provides the ability to "pin" the orientation of a ferromagnetic film.

Subheadings are utilized below for explanation purposes. The subheadings are not meant to limit the disclosure but are for ease of understanding.

I. Scale-Up of the Magnetic Thin Film Electroless Deposition

On-chip magnetic inductors/transformers are passive elements with wide applications as on-chip power converters and radio frequency (RF) integrated circuits. In order to achieve high energy density, magnetic core materials with thicknesses ranging several hundred nanometers to a few microns are often required. Ferrite materials that are often used in bulk inductors have to be processed at high temperature, e.g., higher than 800° C. Such a high temperature is not compatible with complementary metal-oxide semiconductor (CMOS) chip wiring processing temperatures that are kept below 400° C. for the chip wiring and below 250° C. for the solder bumps. The majority of the reported magnetic materials for integrated on-chip inductors are soft magnetic alloys such as NiFe, CoZrTa, and CoFeB.

These magnetic materials (i.e., soft magnetic allows) are typically deposited by vacuum deposition techniques such as physical vapor deposition (PVD) or chemical vapor deposition (CVD). Vacuum methods have the ability to deposit a large variety of magnetic materials. Vacuum processes typically result in deposits that are difficult to pattern or shape accordingly. Excess deposits need to be removed by a combination of etching and planarization processes and this approach adds considerable cost to the final product. Additionally, patterning these materials leaves jagged and sloping edges, which tend to nucleate strongly pinned magnetic domains.

Compared to ferrite materials, magnetic alloys usually have significantly higher permeability and magnetic flux density, which are needed to achieve high energy density for on-chip devices. However, the resistivity of polycrystalline magnetic alloys is usually low (<100 μΩ·cm).

It has been experimentally shown that CoWP layers, suitable for integrated magnetic core inductors, may be fabricated with a resistivity of 110 μΩ·cm and with soft magnetic properties that were stable after an anneal to 200° C. The high resistivity for the magnetic CoWP alloy was achieved by increasing the P and the W concentration in the film. The deposited CoWP films were amorphous. Non-magnetic lamination layers of NiP were deposited and structures with magnetic CoWP layers laminated with non-magnetic NiP layers were fabricated and evaluated.

Figure 2:
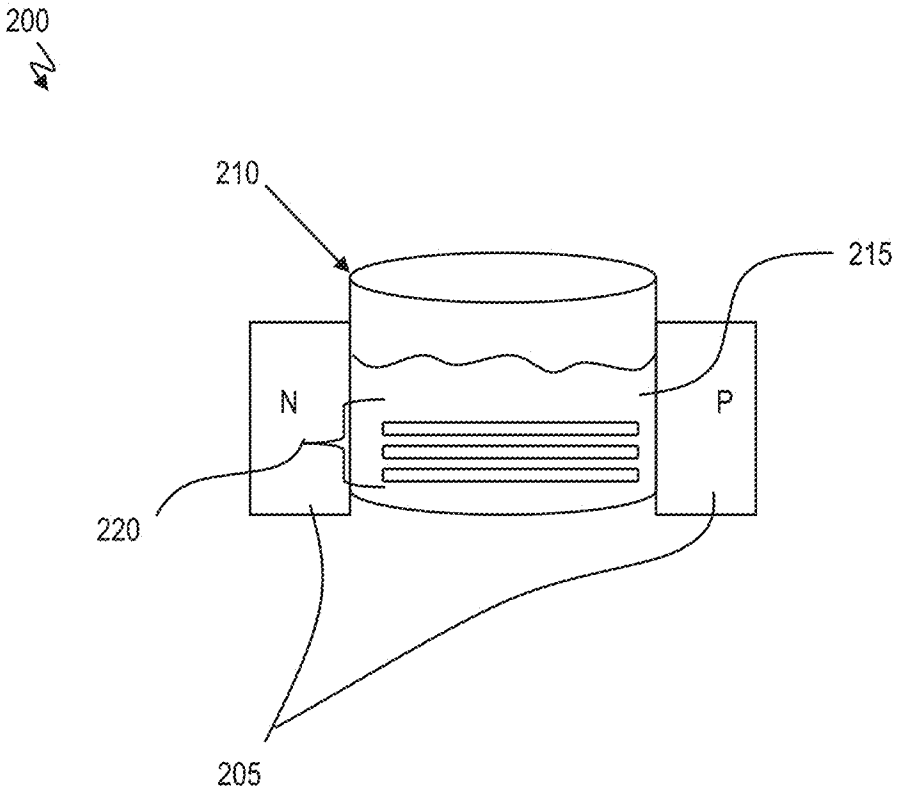
FIG. 2 is a schematic diagram of an exemplary electroless plating apparatus according to an embodiment.

FIG. 2 is a schematic of an example electroless plating apparatus 200 according to an embodiment. It is understood that FIG. 2 is a simplified view of the electroless plating apparatus 200. The apparatus 200 includes a permanent magnet 205 for applying a field bias, e.g., roughly estimated to be 1 Tesla while plating in one implementation. The magnetic field is 0.15 Tesla at the wafer center. A double jacketed glass beaker 210 is placed between the poles (N and S) of the magnet 205, and the beaker 210 is filled with the electroless solution 215. The electroless solution 215 may also be referred to as a bath, solution bath, solution, etc., and the electroless solution 215 may have different mixtures according to the particular application. A Cole Palmer Polystat model H6L heater was used to heat the water circulating in an external jacket (not shown) of the beaker 210 to a constant temperature. The double jacketed cells used for the electroless deposition of the magnetic films have slotted wafer holders for the placement of the wafers 220 between the poles of the magnet 205 during deposition. The samples (i.e., wafers 220) were oriented with the plated surface always being in line with the magnetic flux lines. In this example, a 200 mm plating cell can process many wafers. Although the wafers 220 are placed horizontally between the poles of the permanent magnet, the entire setup may be rotated 90°.

II. Electroless CoWP Chemistry

In order to activate the magnetic NiFe or CoFeB seed layer surface, a 55 ppm palladium sulfate solution in 10% sulfuric acid was used at room temperature (22° C.) for 2 minute (min). The palladium dissolves the NiFe or CoFeB seed layer and creates a 10-20 Angstrom (Å) thin layer of palladium nanoparticles on the surface. Optionally, the Pd activation step can be omitted.

Figure 4:
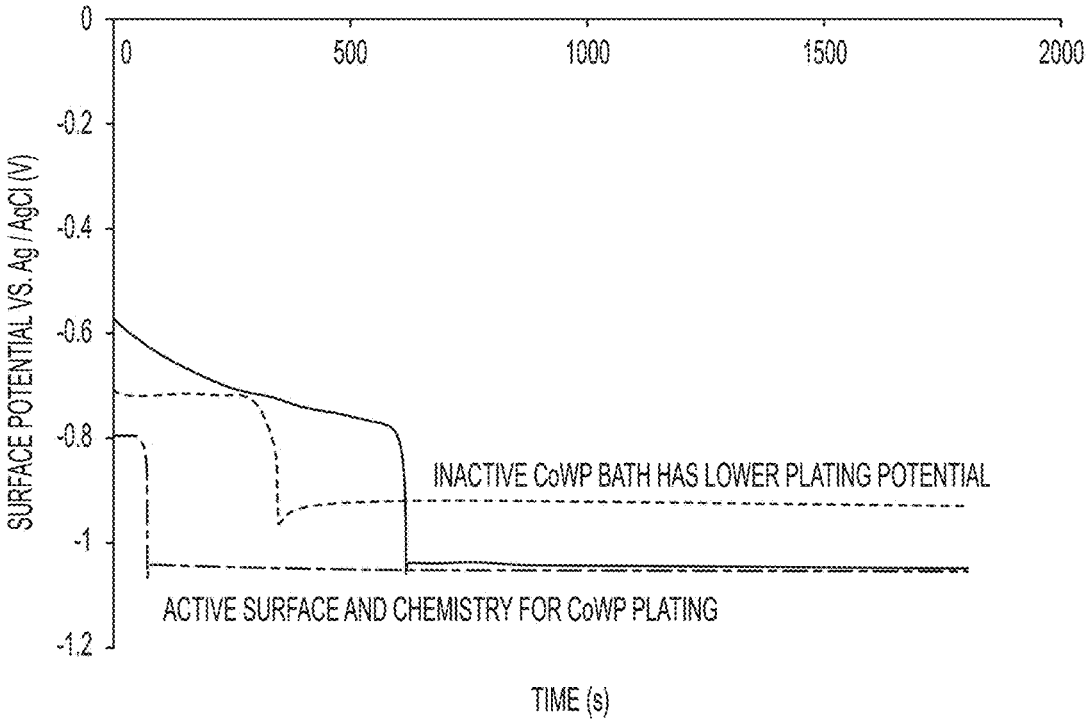
FIG. 4 is a graph of surface potential measurements for CoWP bath activity according to an embodiment.

An electroless bath 215, which contained cobalt sulfate, sodium hypophosphite, sodium tungstate, citric acid as a metal complexant, boric acid as a buffer, polyethylene glycol as an additive and lead acetate as a bath stabilizer, was used for the CoWP electroless deposition. The polyethylene glycol prevented spontaneous plating on silicon at the back-side of the wafer 220. The solution pH was adjusted to 9.0+0.15 at room temperature (22° C.). The electroless deposition was carried out at 90° C.±1° C. Example bath composition for electroless CoWP deposition and operating conditions of plating are shown in Table 1 of FIG. 3. Table 1 illustrates bath composition and operating conditions of electroless for CoWP according to an embodiment. In order to activate the electroless plating, an activation solution (e.g., used in the bath solution 215) was formulated that contained all the CoWP solution components except for the metal salts of cobalt and tungsten. The activation solution (i.e., the solution 215) was heated to 90° C. and was used for activation and hydrogen bubble generation for about 15 minutes (min). The deposition rate was pre-calibrated to be around 5-10 nanometers (nm) per min, and a typical deposition time was 90 min for a thickness of 500 nm. A method that determined the CoWP bath activity was developed, and determining the CoWP bath activity is based on a measurement of the surface potential of the NiFe seed layer as shown in FIG. 4, which allows for detection of long incubation times and inactive CoWP bath plating potentials. FIG. 4 is a graph of surface potential measurements indicating CoWP bath activity on the y-axis and time on the x-axis according to an embodiment. For example, the surface potential of NiFe seed in an active CoWP bath is −1.05 volts (V) vs. Ag/AgCl. The surface potential of NiFe seed in an inactive CoWP bath is −0.95 V vs. Ag/AgCl. The method described in FIG. 4 is a way to assess the CoWP activity. If the measured potential of the CoWP chemistry is more negative than −1.05 V vs. Ag/AgCl, then the CoWP deposition rate is nominally 5-6 nm/min. If the measured surface potential (voltage) is more positive than −0.95 V, then the bath is considered inactive and the CoWP deposition rate can vary from low to no deposition.

III. Non-Magnetic NiP as a Spacer for Lamination of CoWP

In exemplary experiments, a 55 parts per million (ppm) palladium sulfate solution in 10% sulfuric acid was used for 2 min at room temperature in order to activate the CoWP for electroless plating. An electroless bath, which contains nickel sulfate, sodium acetate, and sodium hypophosphite as a reducing agent with pH 4, was employed for the NiP deposition as described in Table 2 of FIG. 5. Table 2 illustrates a bath composition and operating conditions for electroless plating of NiP. NiP films were deposited on copper seed layers and the magnetic properties of the NiP films were measured. When measured, e.g., using a Vibrating Sample Magnetometer (VSM), the samples (e.g., wafers 220) did not show a magnetic hysteresis loop, indicating that the NiP films are non-magnetic.

The experimenters developed a chemistry that produces a $Ni_3P$ thin film that has non-magnetic properties for use as the laminated layer in between CoWP layers (magnetic layers) and/or in between NiFe layers (magnetic layers). To achieve a desired non-magnetic $Ni_3P$ layer, the nickel and phosphorus have a 3:1 ratio of nickel to phosphorus deposited on top of CoWP, and the non-magnetic $Ni_3P$ layer has a (target) thickness between 2-500 nm, in one implementation. The experimenters determined that a combination of nickel, acetate, and hypophosphite at pH 4 can achieve the 3:1 ratio of Ni:P at 50° C. to 80° C. NiP plated samples (i.e., wafers 220) were confirmed to be non-magnetic with VSM, and stacks of CoWP/$Ni_3P$/CoWP were built as proof of concept. In order to create the required thickness for the laminated layers of $Ni_3P$ (e.g., 2-500 nm), a lower temperature for the $Ni_3P$ deposition is preferred (but not a necessity), and 50° C. was used in one implementation. At 50° C. the NiP deposition rate is 2-5 nm/min depending upon whether Pd activation is used.

Figure 6:
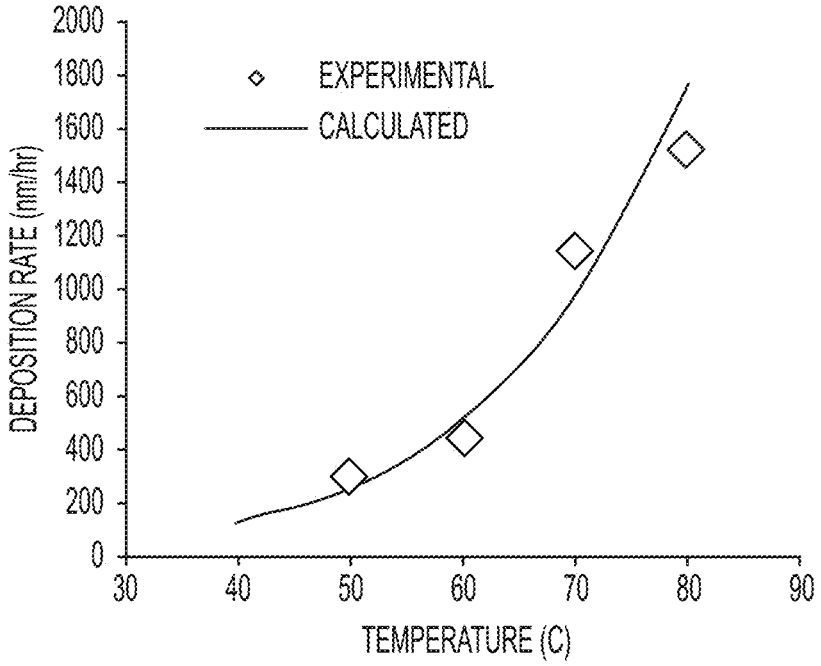
FIG. 6 is a graph of deposition rate as a function of bath temperature for the NiP chemistry according to an embodiment.

At 50° C. and with Pd activation, the rate of NiP deposition is 5 nm/min as shown in FIG. 6, and 40 nm thick films were deposited on top of the CoWP films. FIG. 6 is a graph illustrating deposition rate as a function of bath temperature for the NiP chemistry according to an embodiment. The target thickness of NiP was picked based on the assumption that the NiP electroless layer is pinhole free when its thickness is 10-500 nm. Different thicknesses of NiP were investigated with a single, double, and quadruple lamination of CoWP and NiP to determine what thickness of NiP provides a pinhole free deposit and promotes magnetostatic coupling of magnetic domains of the adjacent CoWP layers.

IV. Annealing

Some samples (i.e., wafers 220) were annealed in a vacuum furnace (Magnetic Solution, MRT-1000) where a magnetic field of 1 Tesla was applied along the easy axis. For the thermal testing, samples were placed in a Hereaus oven under a constant flow of forming gas. The annealing temperature was set to 200 or 250° C. for one hour. A temperature ramping rate of 5° C./min and a cooling rate of 5° C./min under constant nitrogen gas flow was used.

After the CoWP or the laminated CoWP/NiP/CoWP/NiP/CoWP/NiP/CoWP deposition, samples were annealed for 30 minutes at 150° C. in a vacuum oven with an applied magnetic field of 1 T, and annealed at 200° C. and at 250° C. in a forming gas atmosphere for 1 hour. This post deposition annealing was implemented for stress relaxation and for evaluating the film magnetic properties in a post annealed state. These conditions simulated annealing conditions of insulator curing during the building of the inductor device.

V. Measurements and Characterization

Sheet resistance measurements were obtained with a Magnetron Instruments M700 4-point probe immediately after deposition, and also after annealing. An average resistivity was calculated from the sheet resistivity utilizing the total film thicknesses involved. The seed and plated layers have different resistivity (and the layer resistivity may vary within the individual layer thickness), but the average value for a representative total thickness is characteristic of what will be important in electrical usage.

Magnetic hysteresis loop measurements were performed using a Vibrating Sample Magnetometer (VSM) (MicroSense Model 10) on nominally one inch square samples. The applied magnetic field was typically varied between −100 Oe and +100 Oe. Precise reporting of moment densities was not emphasized in this work, but moment values reported were observed to be generally consistent to ±5 to 10%. Any differences greater than this within a series, for example before and after annealing, are likely changes characteristic of the samples involved.

Crystallographic characterization was performed in a Philips XRD System using Cu Kα line radiation. Cross sections of the specimens were prepared using a focus ion beam (FIB 200TEM workstation), and images were taken in a scanning electron microscope (LEO Zeiss 1560) or with a transmission electron microscope with energy dispersive spectroscopy (TEM/EDS).

Secondary ion mass spectrometry (SIMS) depth profile experiments were performed on a magnetic sector Cameca Wf Ultra instrument equipped with a 36° $O_2^+$ column and a floating 60° $Cs^+$ column. Profiles for different trace metals were acquired using a 150 nA3 kilo-electronvolt (keV) $O_2^+$ ion beam, while analyzing positive ions ($^{59}Co^+$, $^{184}W^+$, $^{31}P^+$) at high mass resolution (M/ΔM=4000) to eliminate mass interferences. Due to the absence of standard samples in the SIMS analysis, count number comparisons between different diffusion species of Co, W, P was not utilized.

Compositional and thickness analyses were performed on the films by Rutherford Backscattering Spectrometry (RBS) using an NEC 3UH Pelletron instrument. The analysis beam was $4He^+$ at an energy of 2.3 mega-electronvolt (MeV) with a beam current of 30 nanoamps (nA). The total collected charge was 40 microcoulombs (μC). The samples were tilted by 7 degrees off normal and the scattered He ions were detected at a backscattered angle of 170° degrees. The film composition was determined by the ratio of the Co, W, and P peak areas or by the ratio of Co, Fe, and B peak areas. The film thickness was determined by the sum of the Co, W, P peak areas, using the bulk CoWP density. Permeability measurements were performed using a Ryowa Permeameter model PMF-3000.

V. Example Results of Laminated CoWP Films with NiP

Figure 7:
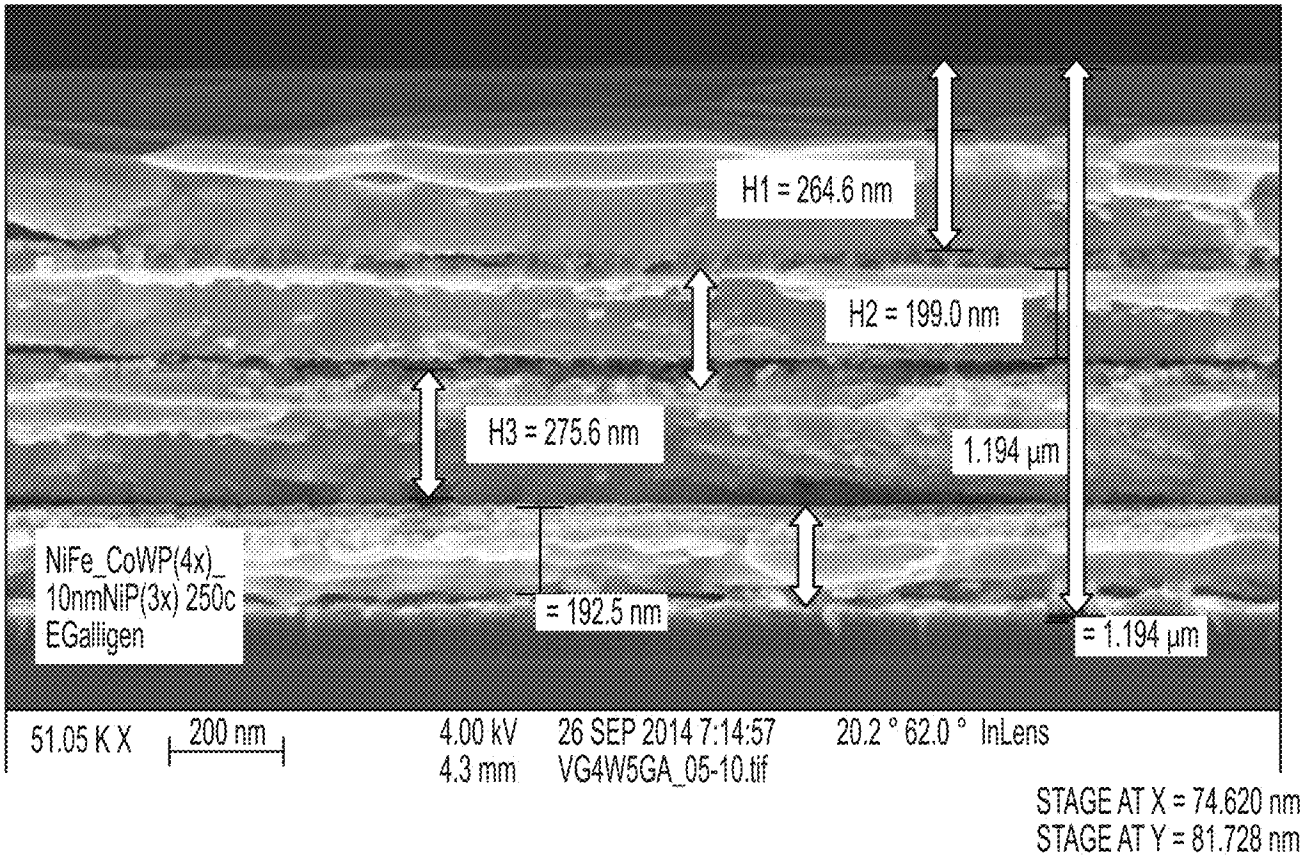
FIG. 7 is a cross-sectional view of a scanning electron microscope image of a laminated magnetic multilayer structure (sample) with four layers of CoWP and three layers of NiP according to an embodiment.
Figure 8:
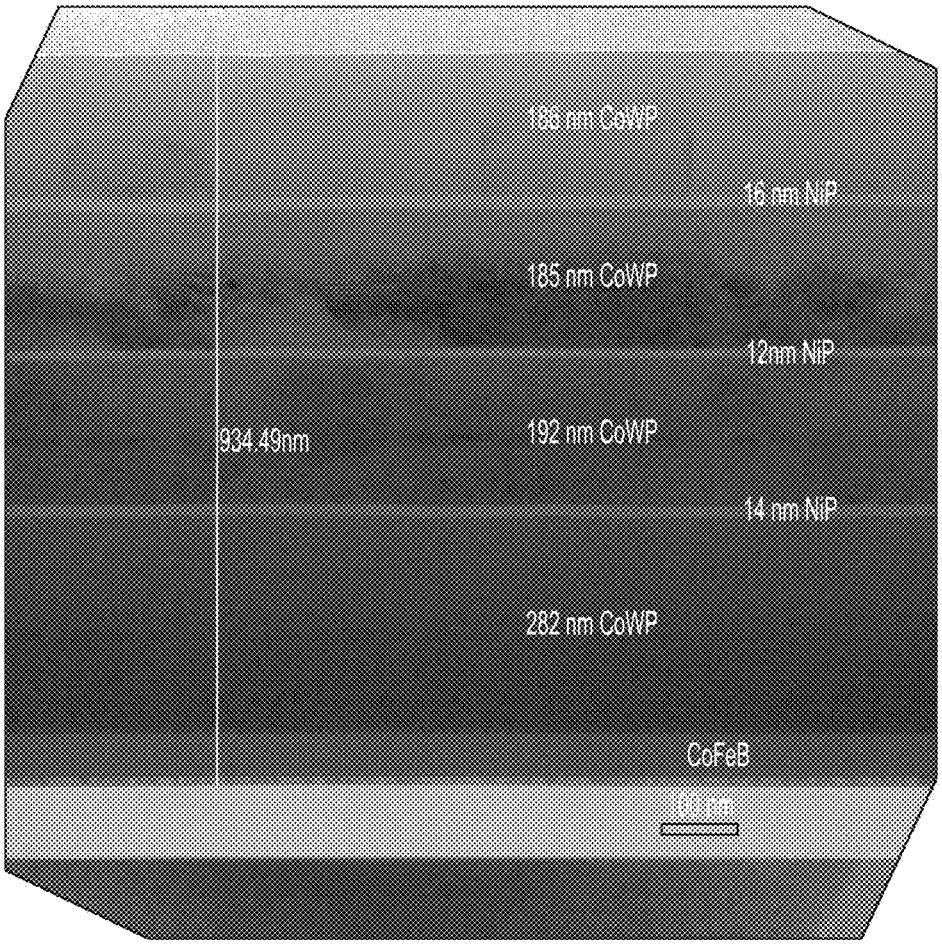
FIG. 8 is a cross-sectional view of a transmission electron microscope (TEM) image of a laminated magnetic multilayer structure with four layers of CoWP and three layers of NiP according to another embodiment.

Magnetic thin films with insulator multilayer laminated structures have attracted considerable attention because of their ability to substantially reduce eddy current loss compared to the single magnetic layers. According to an embodiment, laminated multilayer structures were fabricated using thin nonmagnetic insulating films of NiP. The NiP films were deposited by electroless deposition. According to an embodiment, FIG. 7 is a cross-sectional view of a scanning electron microscope image illustrating a laminated sample with four layers of about 250 nm thick CoWP and three layers of about 10 nm thick NiP. The total thickness of the laminated film is 1.194 μm. Each NiP layer is disposed between two CoWP layers, such that the magnetic CoWP layers are separated one from another by a NiP layer. According to another embodiment, FIG. 8 is a cross-sectional view of a transmission electron microscope image showing a laminated multilevel structure with four magnetic CoWP layers separated by NiP non-magnetic layers. Each of the four magnetic CoWP layers is about 200 nm thick, and the NiP non-magnetic layers (laminate) is about 20 nm thick.

Figure 9:
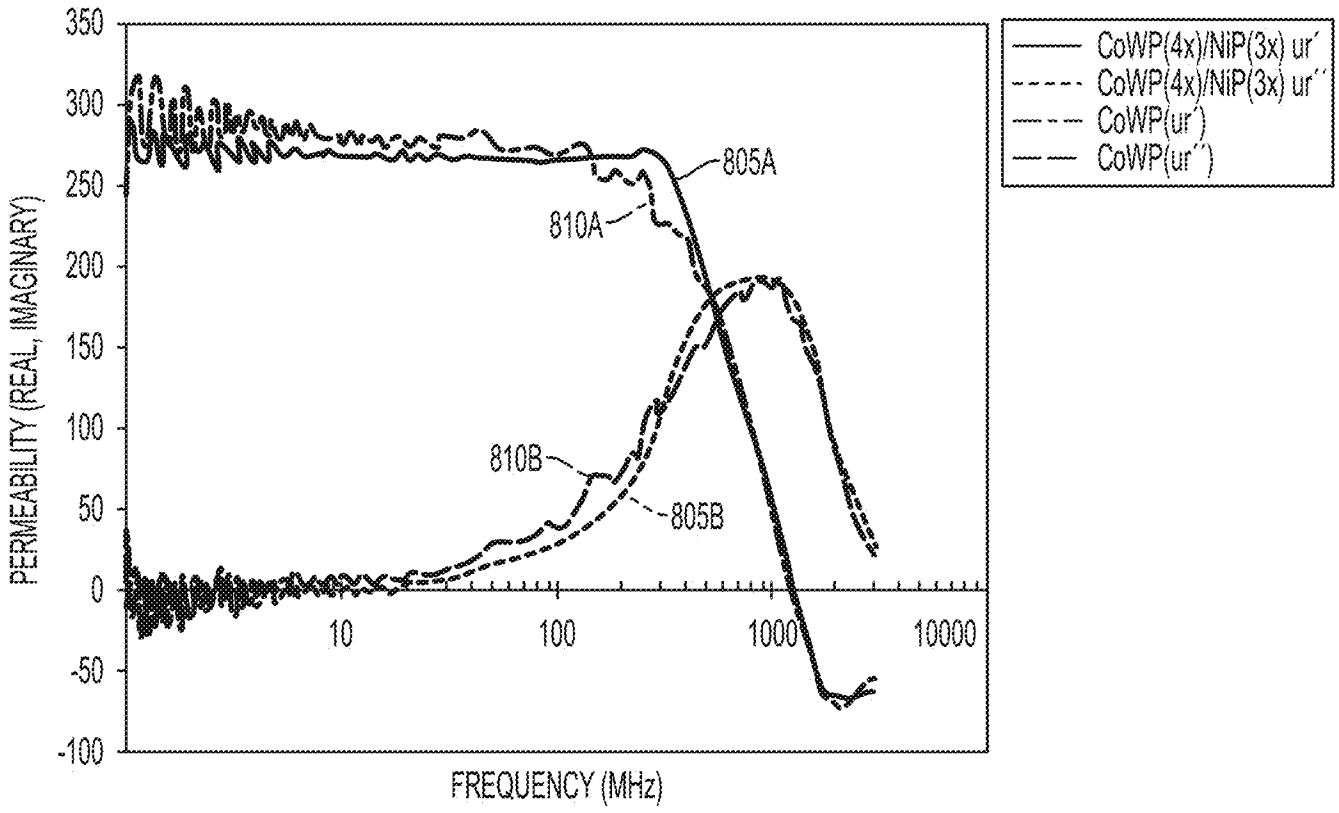
FIG. 9 is a graph of permeability measurements versus frequency according to an embodiment.

Depositions of each layer of CoWP were always performed in the presence of a magnetic field, while the depositions of each layer of NiP were performed without the magnetic field. Permeability measurements of a 250 nm CoWP (four layers (4×)) and NiP (three layers (3×)) laminated structure are shown FIG. 9. FIG. 9 is a graph showing the permeability measurements on the y-axis and the frequency on the x-axis according to an embodiment.

For the alternatively laminated films of CoWP layers and NiP layers (totaling 1.15 μm), a waveform 805A is the real part of relative permeability and a waveform 805B is the imaginary part of relative permeability. For the single 1.23 μm CoWP layer, the real part of the permeability is 810A and the imaginary part is of the permeability is 810B. The real part of relative permeability in waveform 805A has a constant value of 250-300 (dimensionless number with no units) with a roll off frequency at 350 MHz higher than the waveform 810A for the single CoWP layer that has a roll off frequency at 250 MHz. The imaginary part of the relative permeability has a broad peak at 1 GHz possibly indicating good magnetic behavior at high frequency. The permeability measurements demonstrate that the laminated films (of CoWP layers and NiP layers) have lower losses at a frequency higher than 100 MHz.

Figure 10B:
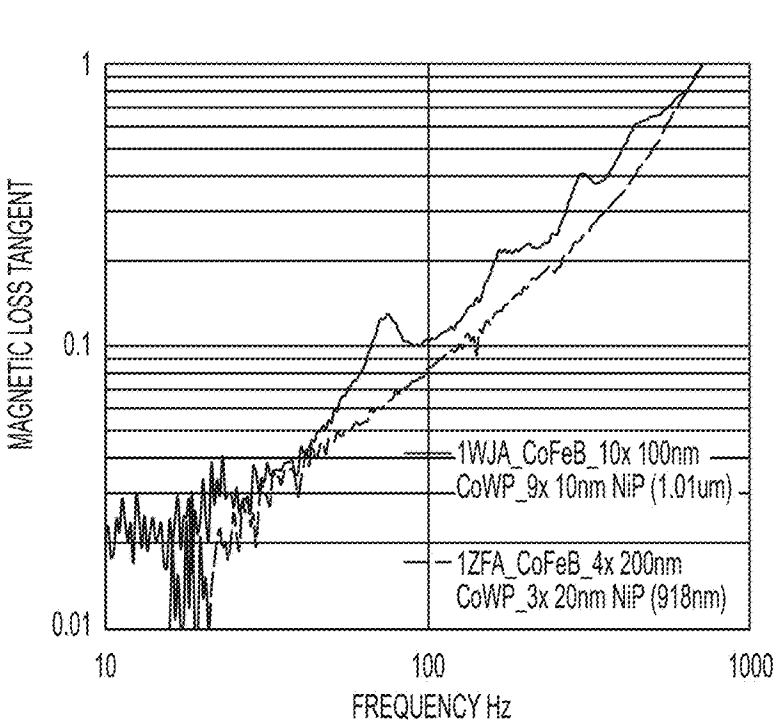
FIG. 10B is a graph of magnetic loss tangent versus frequency according to another embodiment.
Figure 10A:
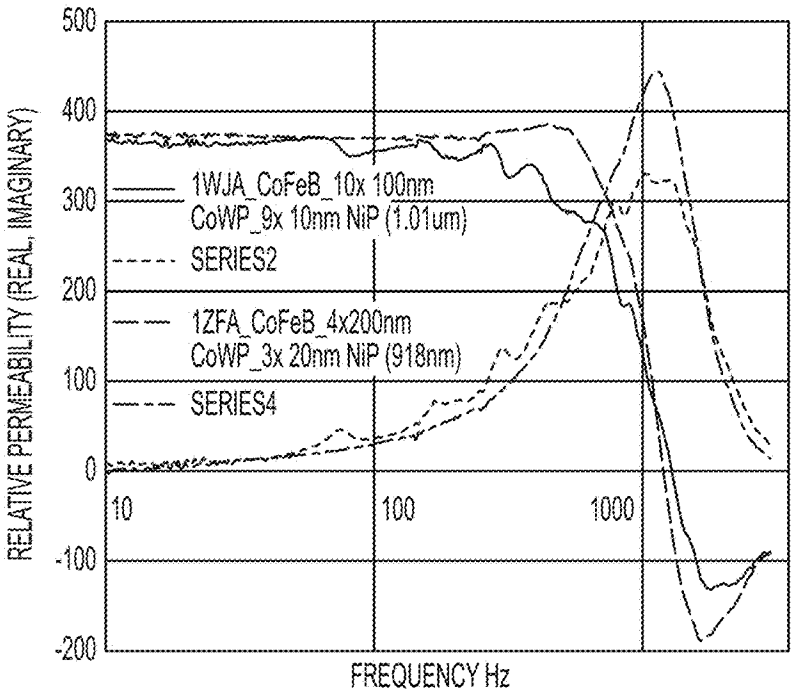
FIG. 10A is a graph of permeability measurements versus frequency according to another embodiment.

FIGS. 10A and 10B are graphs that describe permeability measurements of very thin and ineffective lamination where the laminated film acts as a single CoWP layer. The waviness in the permeability curves (FIG. 10A) and the magnetic loss tangent (FIG. 10B) are indicative of eddy currents forming within the single CoWP layer.

Figure 11A:
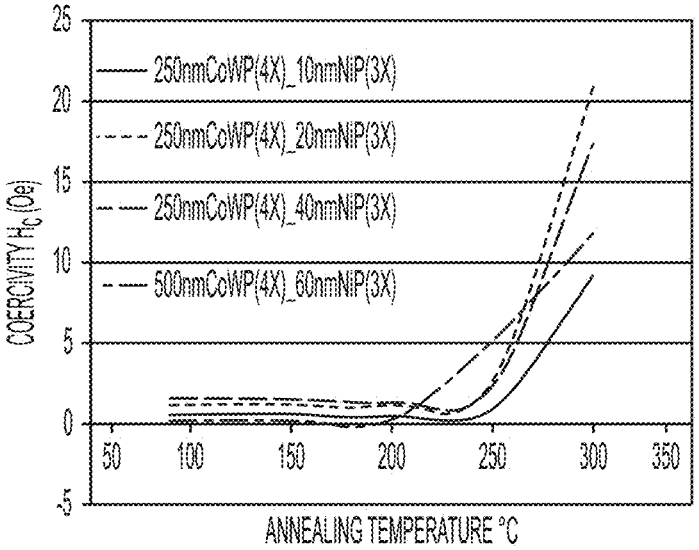
FIG. 11A is a graph of easy axis coercivity according to an embodiment.
Figure 11B:
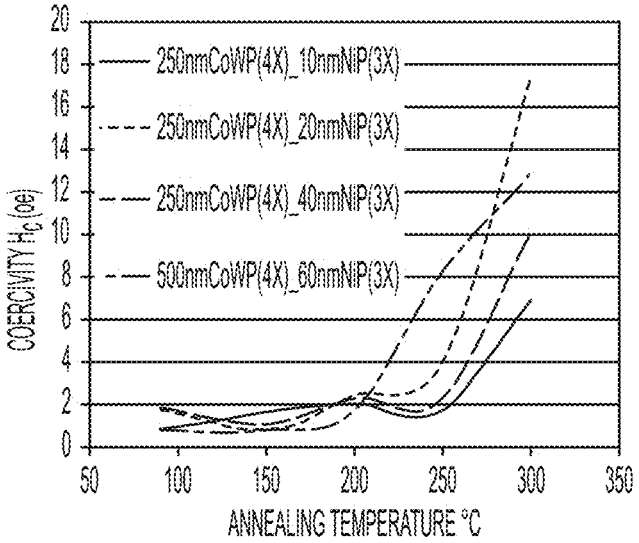
FIG. 11B is a graph of hard axis coercivity according to an embodiment.

According to an embodiment, FIG. 11A is a graph illustrating easy axis coercivity, and FIG. 11B is a graph illustrating hard axis coercivity. Magnetic measurements are shown of the laminated CoWP (four layers (4×)) and NiP (three layers (3×)) films on a 200 mm wafer as a function of annealing temperature (easy axis coercivity Hc (FIG. 11A) and hard axis coercivity Hc (FIG. 11B)). Magnetic properties measurements were performed for different CoWP laminated structures having 10 nm, 20 nm, and 40 nm of NiP non-magnetic spacer layers. The total thickness of CoWP was 250 nm (in one example) and 500 nm (in another example) each with four CoWP layers.

The graphs in FIGS. 11A and 11B are plots of the measured easy axis and hard axis coercivity, respectively, as a function of annealing temperature. The plots reveal that the 250 nm CoWP laminated films are magnetically stable to 250° C. However, the 500 nm laminated CoWP films are only stable to 200° C. It is noted that the thicker laminated 500 nm CoWP films exhibit a sharp increase in coercivity above 200° C. At 300° C. the coercivity of the 500 nm thick films increases by an order of magnitude compared to the as-deposited films and films are no longer magnetically anisotropic. It is believed that the lower thermal stability of the 500 nm CoWP films is due to partial recrystallization of the amorphous thicker films at temperatures above 200° C. Laminated magnetic structures, with magnetic layers thinner than 500 nm, remain amorphous after thermal annealing to 250° C., and as a result, a single magnetic domain is expected to form within each magnetic layer.

Figure 12A:
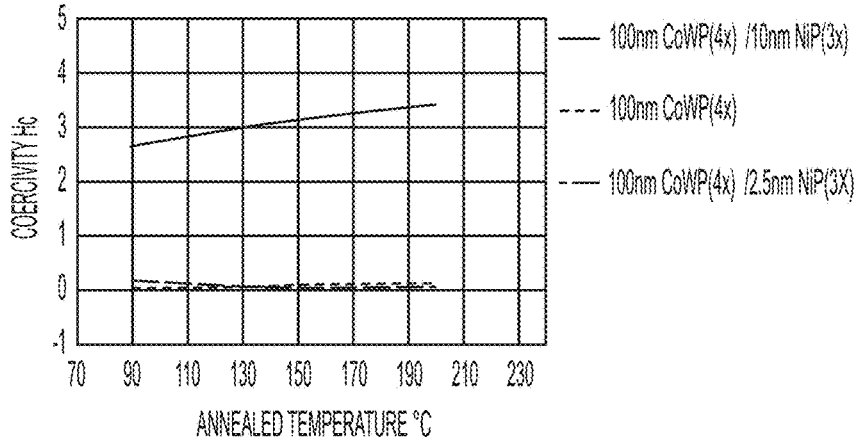
FIG. 12A is a graph of easy axis coercivity according to an embodiment.
Figure 12B:
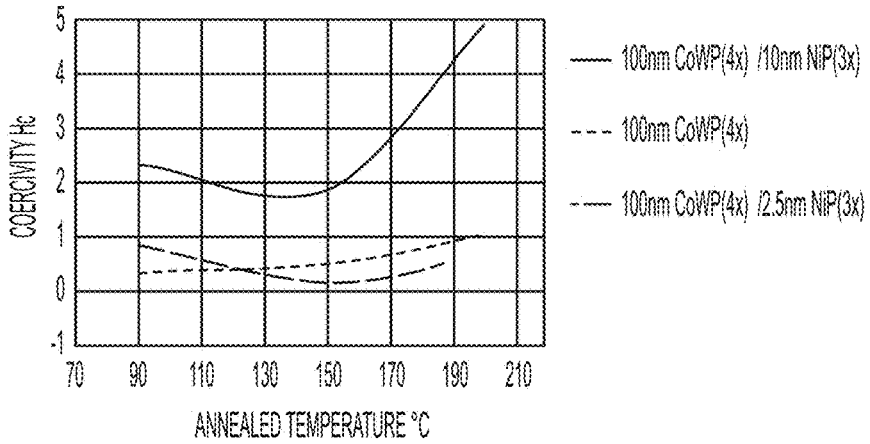
FIG. 12B is a graph of hard axis coercivity according to an embodiment.

Next, a laminated structure of CoWP film with 100 nm CoWP layers and 10 nm NiP non-magnetic spacers in between was examined. In this laminated structure, the CoWP film at the bottom is as thin as 67 nm. The total thickness of the laminated films is 0.357 μm. Layers are progressively thicker and smother from bottom to the top of the structure. FIGS. 12A and 12B are graphs of the magnetic properties of the laminated structures (similar to that discussed above) that were plotted as a function of annealing. In FIG. 12A (easy axis coercivity Hc) and 12B (hard axis coercivity Hc), the magnetic measurements were of the 100 nm laminated CoWP (4×)/NiP (3×) films (i.e., CoWP/NiP/CoWP/NiP/CoWP/NiP) on a 200 mm wafer as a function of the annealing temperature.

Figure 13A:
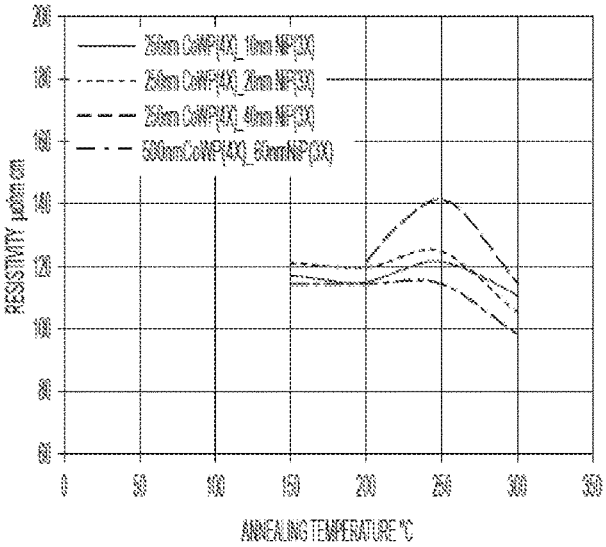
FIG. 13A is a graph of resistivity as a function of annealing temperature for laminated CoWP and NiP structures according to an embodiment.

FIG. 13A is a graph illustrating the resistivity as a function of annealing temperature for laminated CoWP (4×)/NiP (3×) structures having thick CoWP laminated films that are 250 nm and for varied NiP non-magnetic spacer layers. In one exemplary structure, each NiP layer is 10 nm thick in between the CoWP layers. In another exemplary structure, each NiP layer is 20 nm thick in between the CoWP layers. In yet another exemplary structure, each NiP layer is 40 nm thick in between the CoWP layers. In a different exemplary structure, each NiP layer is 60 nm thick in between the CoWP layers. The resistivity of the laminated films reaches a maximum at 250° C. with annealing. It is noted that this (maximum resistivity at 250° C.) is due to the formation of a nickel compound with phosphorous $Ni_3P$. We measured resistivity of the laminated structure to be 110-140 μΩ·cm.

FIG. 13B is a graph illustrating the resistivity as a function of annealing temperature for laminated CoWP (4×)/NiP (3×) structures, having thin CoWP laminated films that are 100 nm. As can be seen, the CoWP film without the NiP non-magnetic layers exhibited a constant resistivity of 100 μΩ·cm.

As can be seen, the 250 nm CoWP/10 nm NiP laminated structure and the 250 nm CoWP/40 nm NiP laminated structure can be utilized for device integration and accommodate the 250° C. maximum temperature integration route. A beneficial requirement for the CoWP/NiP laminated structure is that the interfaces between the layers are smooth and pinhole free. This ensures soft magnetic properties of the laminated structure and antiferromagnetic magnetostactically coupled magnetic layer with low magnetic losses.

Figure 14:
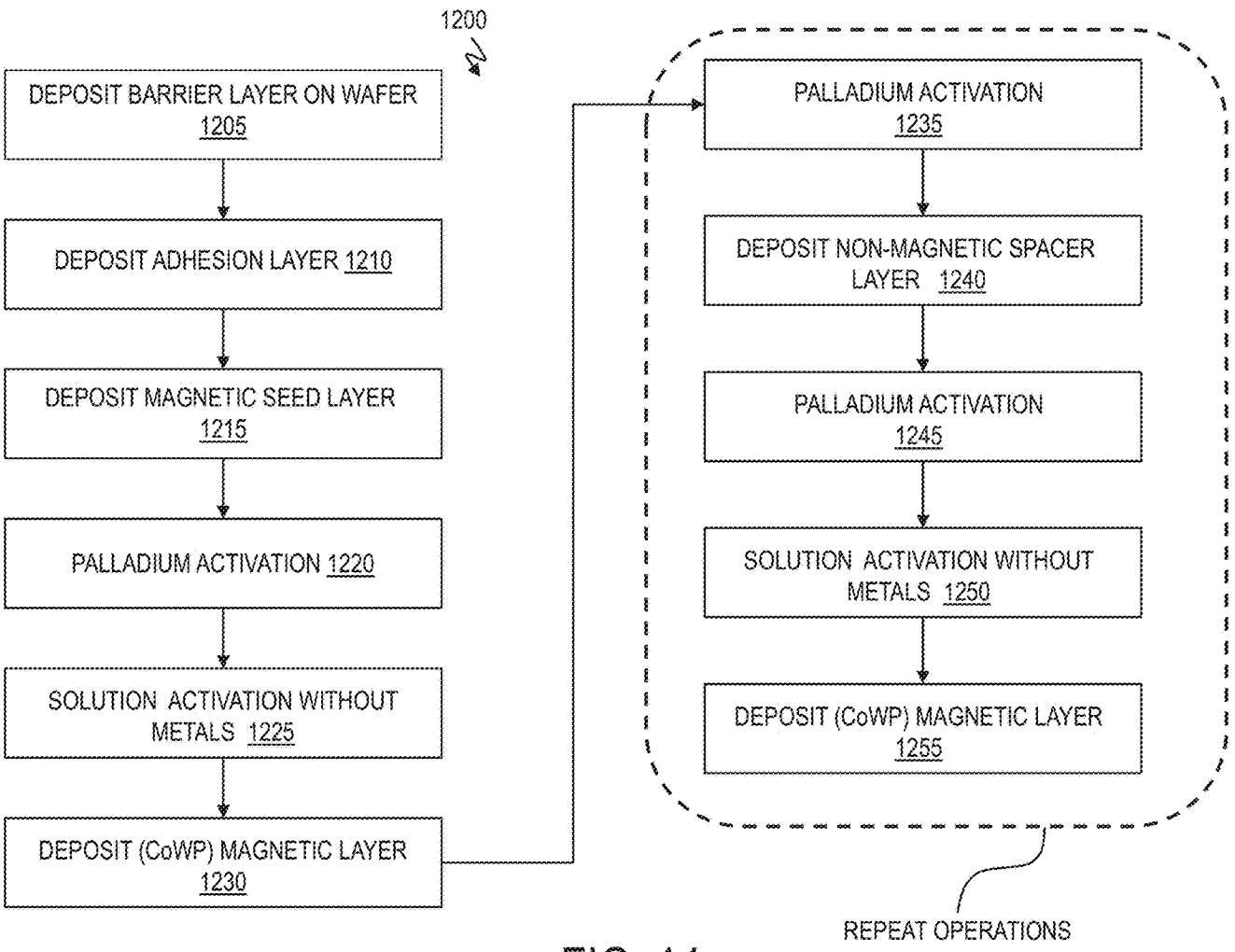
FIG. 14 is a flow chart of a fabrication process for fabricating a laminated multilayer magnetic structure according to an embodiment.
Figure 15:
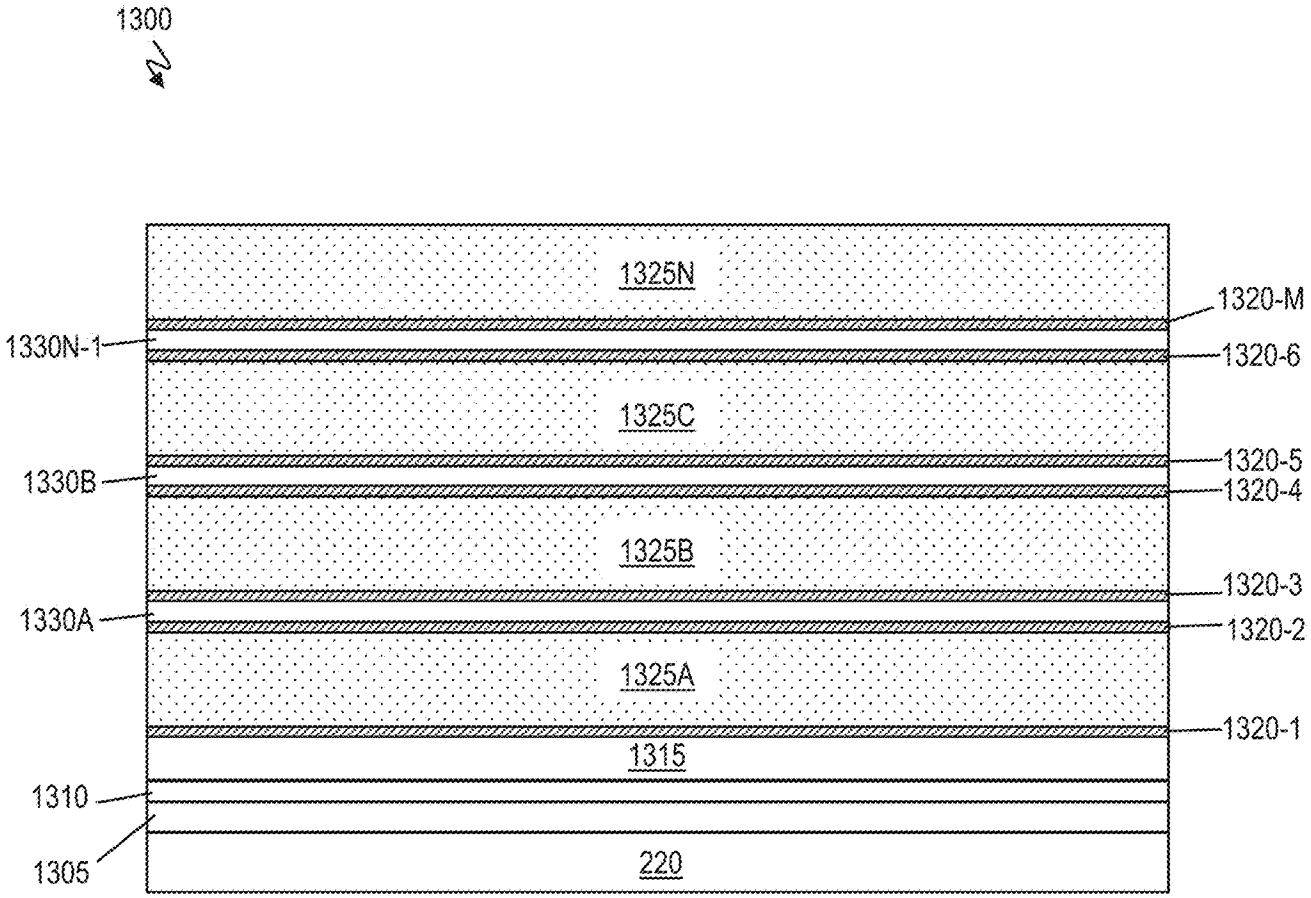
FIG. 15 is a cross-sectional view of the laminated multilayer magnetic structure according to an embodiment.

FIG. 14 is a flow chart 1200 of a fabricating process for fabricating a laminated multilayer magnetic structure 1300 according to an embodiment. FIG. 15 is a cross-sectional view of the laminated multilayer magnetic structure 1300. The laminated multilayer magnetic structure 1300 is not drawn to scale.

At block 1205, a wafer 220 may have a barrier layer 1305 optionally disposed on top. If the wafer 220 is silicon, the barrier layer 1305 may be silicon dioxide grown and/or deposited on the silicon wafer 220. The barrier layer is non-conducting.

At block 1210, an adhesion layer 1310 is disposed on top of the barrier layer 1305 if present, and/or otherwise the adhesion layer 1310 is disposed directly on top of the wafer 220. The adhesion layer 1310 may be deposited by PVD and/or CVD. Example materials of the adhesion layer 1310 may include Ti, TiN, Ta, and/or TaN.

At block 1215, a magnetic seed layer 1315 may be disposed on top of the adhesion layer 1310. The magnetic seed layer 1315 may be deposited by PVD and/or CVD. Example materials may be NiFe, CoFe, NiFePB, and/or CoFePB. It is noted that block 1220 begins the electroless plating fabrication operations.

At block 1220, as an optional Pd activation, a Pd activation layer 1320-1 may be disposed on top of the magnetic seed layer 1315. The Pd activation layer 1320-1 may not necessarily be continuous, and may be nanocrystals or nanoparticles as discussed above. In one implementation, the Pd activation layer 1320-1 may be nanocrystals of Pd about 2-5 angstroms Å thick. The Pd activation layer 1320-1 (though Pd activation layer 1320-M, where M is the last activation layer 1320) acts as a catalyst to activate the surface. In another implementation, Ni or Co may be utilized as the activation layer 1320-1 although Pd works better than both. Ni works better than Co.

At block 1225, optionally, an activation solution without metals may be added to the solution bath 215. As noted above, in order to activate the plating when CoWP is the magnetic layer, the activation solution may be formulated to contain all the CoWP solution components, e.g., in Table 1 except for the metal salts of cobalt and tungsten. When another chemical compound is to be plated, the activation solution is to contain all the materials for plating except for the metals.

At block 1230, a CoWP magnetic layer 1325A is deposited on top of the Pd activation layer 1320-1. In one implementation, the bath solution 215 may include the chemistry discussed in Table 1 in order to deposit the CoWP magnetic layer. Although the example illustrates that the magnetic layers 1325A-1325N (where N is the last magnetic layer 1325) are CoWP, other materials may be utilized for the magnetic layers 1325A-1325N. In one implementation, the magnetic layers 1325A-1325N may include CoWPB where P is less than 15% and B less than 15%. In another implementation, the magnetic layers 1325A-1325N may include NiFePB, where P is less than 15% and B less than 15%. In yet another implementation, the magnetic layers 1325A-1325N may include CoFeBP, where P is less than 15% and B less than 15%.

At block 1235, as an optional Pd activation, the Pd activation layer 1320-2 may be disposed on top of the CoWP magnetic layer 1325A in preparation for depositing a non-magnetic spacer layer.

At block 1240, a non-magnetic spacer layer 1330A is deposited on top of the Pd activation layer 1320-2. It is again noted that the Pd activation layer 1320 may not be continuous (e.g., may be crystals) and the non-magnetic spacer layer 1330A may actually be deposited directly on portions of the CoWP magnetic layer 1325A. In one implementation, the non-magnetic spacer layers 1330A-1330N−1 may be $Ni_3P$. In one case, the thickness of the $Ni_3P$ is greater than 10 nm but less than 500 nm. In another implementation, the non-magnetic spacer layers 1330A-1330N−1 may be $Co_2P$. In yet another implementation, the non-magnetic spacer layers 1330A-1330N−1 may be $Fe_3P$.

At block 1245, as an optional Pd activation, the Pd activation layer 1320-3 may be disposed on top of the non-magnetic spacer layer 1330A in preparation for depositing a non-magnetic spacer layer.

At block 1250, optionally, an activation solution without metals may be added to the solution bath 215 (just as in block 1225). As noted above, in order to activate the plating, the activation solution may be formulated to contain all the CoWP solution components (in Table 1) except for the metal salts of cobalt and tungsten.

At block 1255, the CoWP magnetic layer 1325B is deposited on top of the Pd activation layer 1320-3 (as discussed in block 1230).

At this point, the fabrication process may continue repeating the plating operations of blocks 1235, 1240, 1245, 1250, and 1255 in a loop until the desired amount of layers has been deposited. The laminated multilayer magnetic structure 1300 is illustrated with activation layers 1320-1 through 1320-M, CoWP magnetic layers 1325A through 1325N, non-magnetic spacer layers 1330A though 1330N−1, and non-magnetic spacer layers 1330A through 1330N−1. More or fewer layers may be fabricated.

Figure 16:
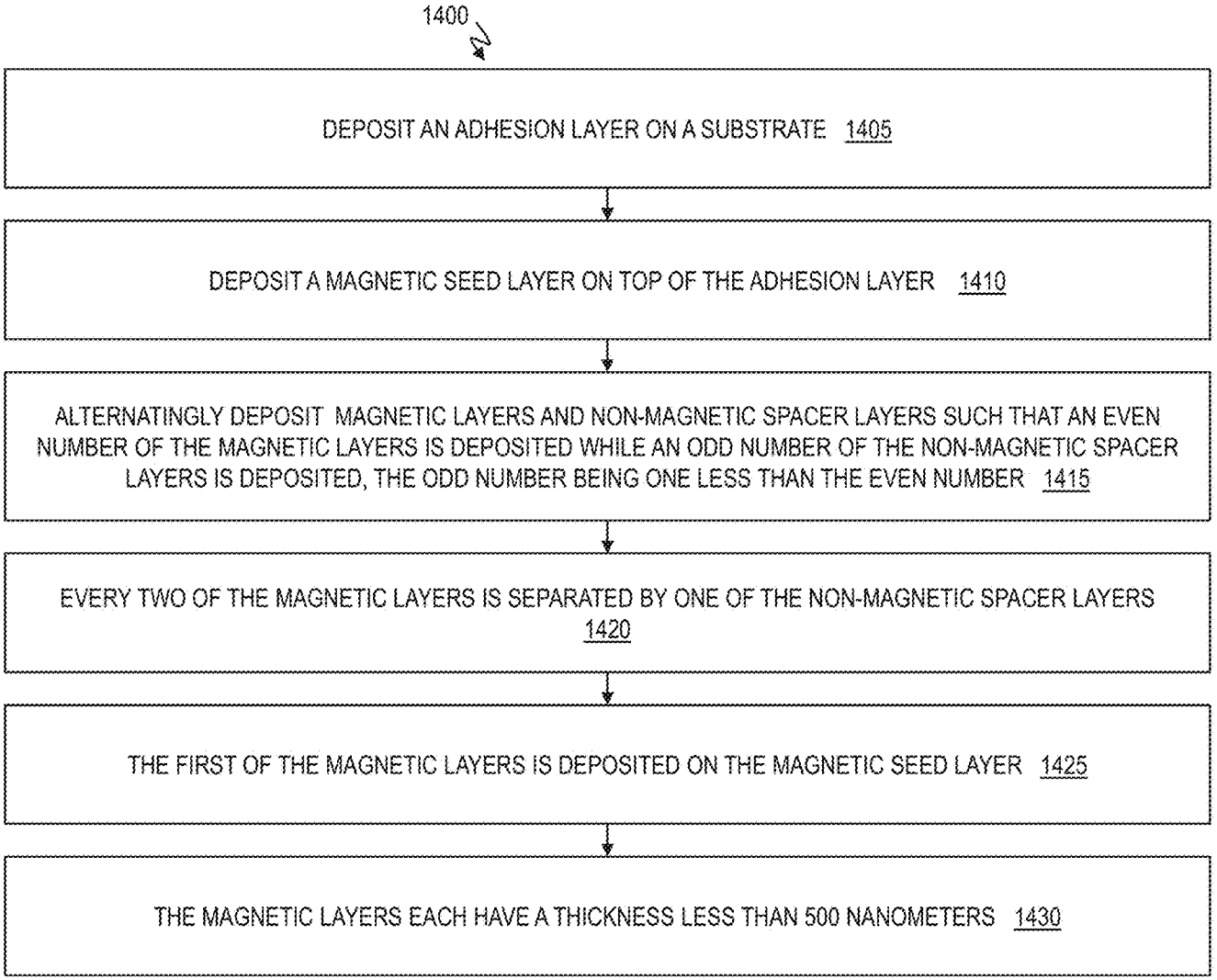
FIG. 16 is a flow chart of a method of forming the laminated multilayer magnetic structure according to another embodiment.

FIG. 16 is a flow chart 1400 of a method of forming the laminated multilayer magnetic structure 1300 according to an embodiment.

At block 1405, the adhesion layer 1310 is deposited on a substrate (e.g., a wafer 220), and the magnetic seed layer 1315 is deposited on top of the adhesion layer 1310 at block 1410.

At block 1415, magnetic layers 1325A through 1315N and non-magnetic spacer layers 1330A through 1330N−1 are alternatingly deposited, such that an even number of the magnetic layers is deposited while an odd number of the non-magnetic spacer layers is deposited, where the odd number (e.g., total magnetic layers N) is one less than the even number (e.g., total non-magnetic spacer layers N−1).

At block 1420, every two of the magnetic layers 1325 is separated by one of the non-magnetic spacer layers 1330. In another words, each of the individual non-magnetic spacer layers 1330 is sandwiched between two individual magnetic layers 1325.

At block 1425, the first of the magnetic layers (e.g., magnetic layer 1325A) is deposited on the magnetic seed layer 1315. At block 1425, the magnetic layers 1325A through 1325N each have a thickness less than 500 nanometers. The experimenters have observed and determined that when the single magnetic layer has a thickness of 500 nm, then single magnetic layer tends to recrystallize from an amorphous layer to a crystalline layer at a temperature of 200° C. Integrating the magnetic materials on a silicon chip requires a processing temperature higher than 200° C. Crystalline magnetic layers exhibit high magnetic losses due to eddy currents and to a high damping coefficient. Ideally, a single magnetic domain is preferred (but not a necessity) in each magnetic layer. The single magnetic domain can be achieved with amorphous magnetic thin films that have a resistivity >110 μΩ·cm.

Further, the magnetic layers 1325 comprise CoWP. The magnetic layers 1325 are selected from a group comprising CoWPB, NiFeBP, and CoFePB, where P has less than 15% and B has less than 15% of the total chemical compound. The magnetic layers are amorphous.

The magnetic seed layer 1315 is selected from a group comprising NiFe, CoFe, NiFeBP, and CoFeBP.

The non-magnetic spacer layers 1330A through 1330N are each of equal thickness. The non-magnetic spacer layers 1330A through 1330N each comprise $Ni_3P$. The $Ni_3P$ has a thickness of 2-500 nm. The non-magnetic spacer layers 1330A through 1330N are selected from a group comprising $Ni_3P$, $Co_2P$, and $Fe_3P$.

Nanoparticles of Pd (illustrated as Pd activation layers 1320-1 through 1320-M) are deposited at interfaces of the magnetic layers 1325 and non-magnetic spacer layers 1330, when the magnetic layers 1325 and the non-magnetic spacer layers 1330 are deposited by electroless plating.

Figure 17:
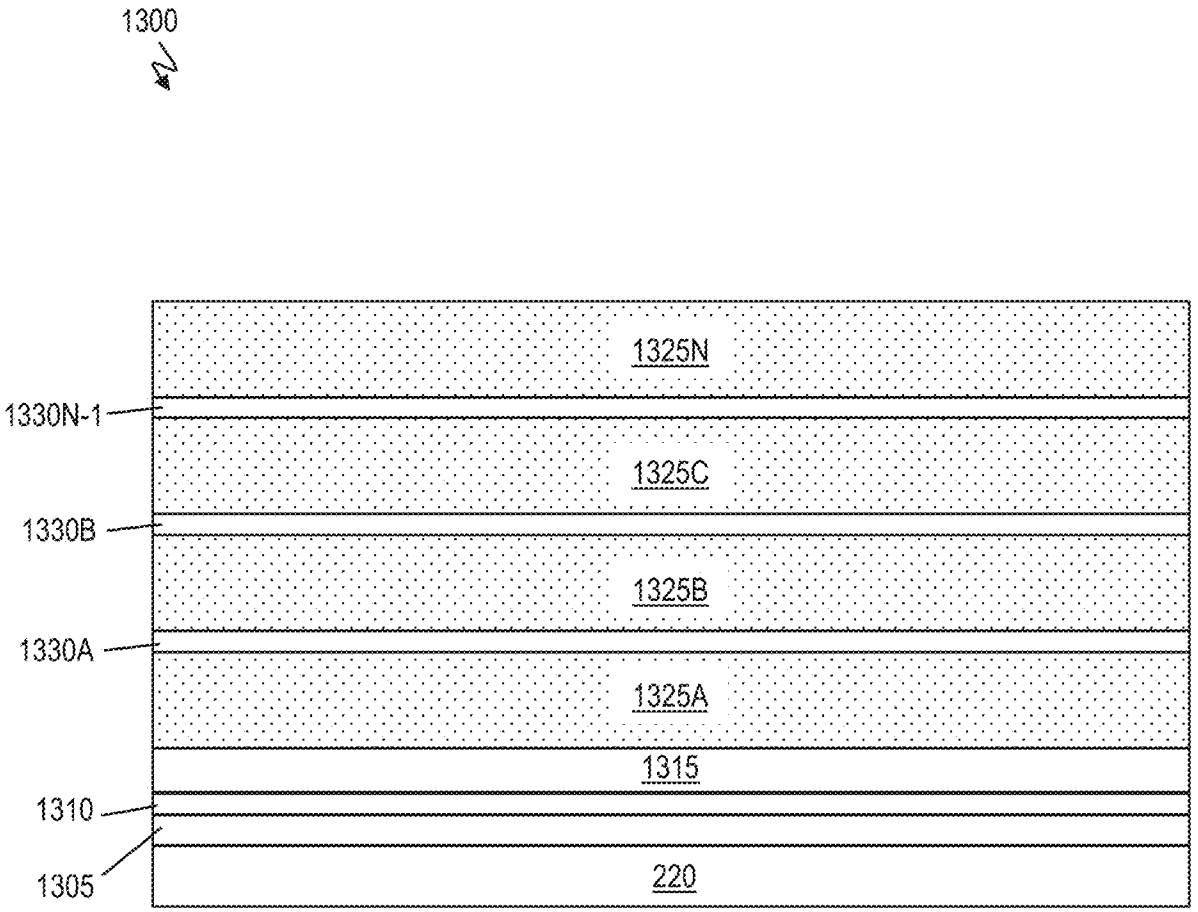
FIG. 17 is a cross-sectional view of the laminated multilayer magnetic structure according to another embodiment.

Nanoparticles of Pd are not utilized when the magnetic layers 1325 and the non-magnetic spacer layers 1330 are deposited by electroplating (and/or other deposition techniques), and the magnetic layers 1325 and non-magnetic spacer layers 1330 are contiguous (i.e., directly touching) without Pd crystals in between as shown in FIG. 17. FIG. 17 is a cross-sectional view of the laminated multilayer magnetic structure 1300 without the Pd activation layers 1320-1 through 1320-M according to an embodiment. The adhesion layer is selected from a group comprising Ti, TiN, Ta, and TaN.

Deposition is any process that grows, coats, or otherwise transfers a material onto the wafer. Available technologies include, but are not limited to, thermal oxidation, physical vapor deposition (PVD), chemical vapor deposition (CVD), electrochemical deposition (ECD), molecular beam epitaxy (MBE) and more recently, atomic layer deposition (ALD) among others.

Removal is any process that removes material from the wafer: examples include etch processes (either wet or dry), and chemical-mechanical planarization (CMP), etc.

Patterning is the shaping or altering of deposited materials, and is generally referred to as lithography. For example, in conventional lithography, the wafer is coated with a chemical called a photoresist; then, a machine called a stepper focuses, aligns, and moves a mask, exposing select portions of the wafer below to short wavelength light; the exposed regions are washed away by a developer solution. After etching or other processing, the remaining photoresist is removed. Patterning also includes electron-beam lithography, nanoimprint lithography, and reactive ion etching.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A magnetic inductor, comprising:

a barrier layer deposited directly on top of a wafer, the barrier layer being an oxide;

an adhesion layer deposited directly on top of the barrier layer, the adhesion layer comprising TiN;

a magnetic seed layer deposited directly on top of the adhesion layer, the magnetic seed layer comprising a layer of an alloy material, the layer of the alloy material is selected from a group consisting of NiFe, CoFe, NiFeBP, and CoFeBP;

magnetic layers and non-magnetic spacer layers alternatingly deposited such that an even number of the magnetic layers is deposited while an odd number of the non-magnetic spacer layers is deposited, the odd number being one less than the even number, the nonmagnetic spacer layers comprising $Ni_3P$;

wherein the magnetic layers comprise CoWP, a combination of the magnetic spacer layers having $Ni_3P$ at a thickness from 10-40 nm and the magnetic layers having CoWP at a thickness of 250 nm being formed with a resistivity of 120-140 μΩ·cm.

2. The magnetic inductor of claim 1, wherein the non-magnetic spacer layers are each of equal thickness.

3. The magnetic inductor of claim 1, wherein the wafer is a silicon wafer.

* * * * *